US012359416B2

(12) United States Patent
Wilson et al.

(10) Patent No.: US 12,359,416 B2
(45) Date of Patent: Jul. 15, 2025

(54) OFFSET ADAPTER FOR FLUSHOMETER

(71) Applicant: Sloan Valve Company, Franklin Park, IL (US)

(72) Inventors: John Wilson, Naperville, IL (US); Jon Demczewski, Batavia, IL (US)

(73) Assignee: Sloan Valve Company, Franklin Park, IL (US)

( * ) Notice: Subject to any disclaimer, the term of this patent is extended or adjusted under 35 U.S.C. 154(b) by 1021 days.

(21) Appl. No.: 17/388,672

(22) Filed: Jul. 29, 2021

(65) Prior Publication Data

US 2021/0355669 A1 Nov. 18, 2021

Related U.S. Application Data

(63) Continuation-in-part of application No. 29/701,219, filed on Aug. 9, 2019, now Pat. No. Des. 951,402.

(51) Int. Cl.
*E03D 11/14* (2006.01)

(52) U.S. Cl.
CPC ..... *E03D 11/14* (2013.01)

(58) Field of Classification Search
CPC ..... F16L 17/02; E03D 1/012
USPC ..... 285/179, 30; 4/252.1
See application file for complete search history.

(56) References Cited

U.S. PATENT DOCUMENTS 2,027,371 A 1/1936 Davison
2,055,489 A * 9/1936 Groeniger ..... E03D 11/18 4/421
D218,825 S 9/1970 Blumer
D278,651 S 4/1985 Horak
D284,887 S * 7/1986 Milo ..... D23/263
D345,413 S 3/1994 Brown
5,819,326 A 10/1998 Kobayashi et al.
(Continued)

FOREIGN PATENT DOCUMENTS

CN 102561502 A 7/2012
DE 202008009465 U1 10/2009
(Continued)

OTHER PUBLICATIONS

Sloan Optima Accessories H-1018—A Offset Adapter Kit Instruction Guide PDF; Revision Date Nov. 2020, Copyright Date 2020; Visited Online Jan. 19, 2022; https://www.sloan.com/sites/default/files/2020-12/08160006.pdf.
(Continued)

*Primary Examiner* — Lauren A Crane
(74) *Attorney, Agent, or Firm* — Banner & Witcoff, Ltd.

(57) ABSTRACT

An offset adapter includes a body having front and rear walls, and a body channel. An inlet portion has first and second ends, and an inlet channel extending from the first end to the second end and in fluid communication with the body channel. An outlet portion has first and second ends, and an outlet channel extending from the first end to the second end and in fluid communication with the body channel. A first recess is formed in the front wall of the body proximate a top of the body and opposite the inlet channel, with a surface of the first recess being forward of the body channel. A second recess is formed in a top of the body forward of the second end of the inlet portion; and a third recess is formed in a bottom of the body rearward of the first end of the outlet portion.

24 Claims, 5 Drawing Sheets

(56) References Cited

U.S. PATENT DOCUMENTS

| | | | |
|---|---|---|---|
| D421,644 | S | 3/2000 | Andersen |
| D425,612 | S | 5/2000 | Andersen |
| D438,938 | S | 3/2001 | Cleek |
| 6,292,956 | B1 | 9/2001 | Kayahara |
| 6,718,564 | B2 | 4/2004 | Duncan et al. |
| 6,783,160 | B2 | 8/2004 | Rowley |
| 6,913,245 | B2 | 7/2005 | Jacoway |
| 7,350,825 | B1 | 4/2008 | Huang |
| D599,447 | S | 9/2009 | Cummings et al. |
| 8,011,029 | B2 | 9/2011 | Kamiya et al. |
| 8,151,821 | B2 | 4/2012 | Ball |
| D678,484 | S | 3/2013 | Dietterle et al. |
| 8,469,403 | B2 | 6/2013 | Benit |
| 8,505,124 | B2 | 8/2013 | Eichler et al. |
| 8,572,768 | B2 | 11/2013 | DeWitt et al. |
| 8,616,229 | B2 | 12/2013 | Jacoway |
| 9,057,460 | B2 | 6/2015 | Ismert et al. |
| 9,856,991 | B2 | 1/2018 | Williams |
| 10,072,770 | B2 | 9/2018 | Aykens et al. |
| 2013/0165828 | A1 | 6/2013 | Sullivan |
| 2015/0330067 | A1 | 11/2015 | Lee et al. |
| 2016/0010774 | A1 | 1/2016 | Davidson |
| 2016/0097191 | A1 | 4/2016 | Morris et al. |
| 2018/0149296 | A1 | 5/2018 | McNall |
| 2021/0355669 | A1 | 11/2021 | Wilson et al. |

FOREIGN PATENT DOCUMENTS

| | | | |
|---|---|---|---|
| DE | 102009048246 | A1 | 4/2010 |
| KR | 200453858 | Y1 | 6/2011 |

OTHER PUBLICATIONS

Sloan Sales Sheet, Offset Adapter PDF; Copyright Date 2020; Visited Online Jan. 19, 2022; https://www.sloan.com/sites/default/files/2020-12/SLO1167-ADA-Adapter-SS.pdf.

Sloan Accessory 33080303 Offset Adapter Spec-Sheet.PDF; Publish Date Oct. 20, 2021; Visited Online Jan. 19, 2022; https://www.sloan.com/spec-sheet/33080101.

Sloan H-1081—A Offset Adapter 1-1/2" on SloanRepair.com; Copyright Date 2022; Visited Online Jan. 19, 2022; https://sloanrepair.com/ products/sloan-h-1018-a-offset-adapter-1-1-2.

Product Spotlight: Sloan Offset Adapter for Sloan Flushometers; Online Blog Posting Date Jan. 27, 2021; Visited Online Jan. 19, 2022; <http://blog.equiparts.net/offset-adapter-sloan-flushometer/>.

Quality Plumbing Supply—Sloan 33080101 H1018A Chrome Plated 1" Npt X 1-1/2" Offset Adapter, Website Copyright Date 2021; Visited Online Jan. 19, 2022; https://qualityplumbingsupply.com/sloan-33080101-h1018a-chrome-plated-1-npt-x-1-1-2-offset-adapter/.

Sloan Offset Adapter H-1018-A; website Copyright Date 2019; Visited Online Jan. 19, 2022; https://www.simsupply.com/departments/industrial/plumbing/toilets-urinals/sloan-offset-adapter-red-chrome-brass-1-1-2-h-1018-a-cu-373833585837/?wi=off&CATARGETID =120012830002322587&CADevice=c&gclid=EAIaIQobCh.

Jul. 1, 2021—(MX) Office Action—App MX/f/2020/000310.

* cited by examiner

OFFSET ADAPTER FOR FLUSHOMETER

CROSS-REFERENCE TO RELATED APPLICATION

This application claims priority as a continuation-in-part of U.S. Design patent application Ser. No. 29/701,219, filed Aug. 9, 2019, which prior application is incorporated by reference herein in its entirety.

FIELD OF THE INVENTION

Aspects of this invention relate generally to an offset adapter for use with a flushometer and, more particularly, to an offset adapter including a body portion, an inlet portion, and an outlet portion, and having internal features to reduce a pressure drop across the adapter.

BACKGROUND OF THE INVENTION

Flushometers are often installed beneath grab bars in flush toilets/water closets. When installing a flushometer for a water closet, in particular a wall hung water closet, the position of the grab bar and the rough-in plumbing can create installation and use issues. An exemplary prior art water closet 10 with a flushometer 12 is seen in FIG. 1. A grab bar 14 is positioned above flushometer 12. In order to be compliant with applicable laws (e.g., the Americans with Disabilities Act or ADA), grab bar 14 is installed at a distance G of 36 inches above the floor 16. With a top of bowl 18 of water closet 10 installed at the standard distance F of 17 inches above floor 16, and the rough-in plumbing for inlet piping 20 for flushometer 12 positioned at a height P of 11.5 inches above the top of bowl 18, the clearance distance CL between the bottom of grab bar 14 and the top of water closet 10 may be as small as 0.65 inches, which does not permit sufficient space to allow for the user to be able to depress a flushing button 22 on the top of flushometer 12, and which is significantly less than the space that may be required by applicable laws, e.g., the ADA, of 1.5 inches.

It is therefore desirable to install the water closet bowl with the flushometer positioned at least 1.5 inches below the grab bar without needing to modify the height of the rough-in plumbing or to modify the flushometer and its associated piping, which would reduce or overcome some or all of the difficulties inherent in prior known configurations. Particular objects and advantages will be apparent to those skilled in the art, that is, those who are knowledgeable or experienced in this field of technology, in view of the following disclosure and detailed description of certain embodiments.

SUMMARY

In accordance with certain embodiments, an offset adapter may include a body, an inlet portion and an outlet portion, and may facilitate connecting a flushometer of a water closet to existing rough-in plumbing, while providing adequate clearance beneath an ADA-compliant grab bar.

In accordance with a first aspect, an offset adapter includes a body having front and rear walls, and a body channel. An inlet portion has first and second ends, and an inlet channel extending from the first end to the second end and in fluid communication with the body channel. An outlet portion has first and second ends, and an outlet channel extending from the first end to the second end and in fluid communication with the body channel. A first recess is formed in the front wall of the body proximate a top of the body and opposite the inlet channel, with a surface of the first recess being forward of the body channel. A second recess is formed in a top of the body forward of the second end of the inlet portion; and a third recess is formed in a bottom of the body rearward of the first end of the outlet portion.

In accordance with another aspect, and offset adapter includes a body having a front wall, a rear wall, and a body channel. An inlet portion has a first end, an opposed second end connected to the body, and an inlet channel extending from the first end to the second end and being in fluid communication with the body channel. An outlet portion has a first end connected to the body, an opposed second end, and an outlet channel extending from the first end to the second end and being in fluid communication with the body channel. A ratio of a length of the adapter extending between the first end of the inlet portion and the second end of the outlet portion to a depth of the body channel extending between the front wall of the body and the rear wall of the body is approximately 6.14.

In accordance with a further aspect, an offset adapter includes a body having a front wall, a rear wall, and a body channel extending between the front wall and the rear wall. An inlet portion has a first end, an opposed second end connected to the body, and an inlet channel extending from the first end to the second end and being in fluid communication with the body channel. An outlet portion has a first end connected to the body, an opposed second end, and an outlet channel extending from the first end to the second end and being in fluid communication with the body channel. An interior surface of the inlet portion has 1 inch Female Pipe Threads ("FPT"), and an exterior surface of the outlet portion has 1 inch Male Pipe Threads ("MPT"). A length of the adapter extending between the first end of the inlet portion and the second end of the outlet portion is approximately 1.758 inches. A distance between a centerline of the inlet portion and a centerline of the outlet portion is approximately 1.5 inches.

These and additional features and advantages disclosed here will be further understood from the following detailed disclosure of certain embodiments, the drawings thereof, and from the claims.

BRIEF DESCRIPTION OF THE DRAWINGS

The foregoing and other features and advantages of the present embodiments will be more fully understood from the following detailed description of illustrative embodiments taken in conjunction with the accompanying drawings in which.

Figure 1:
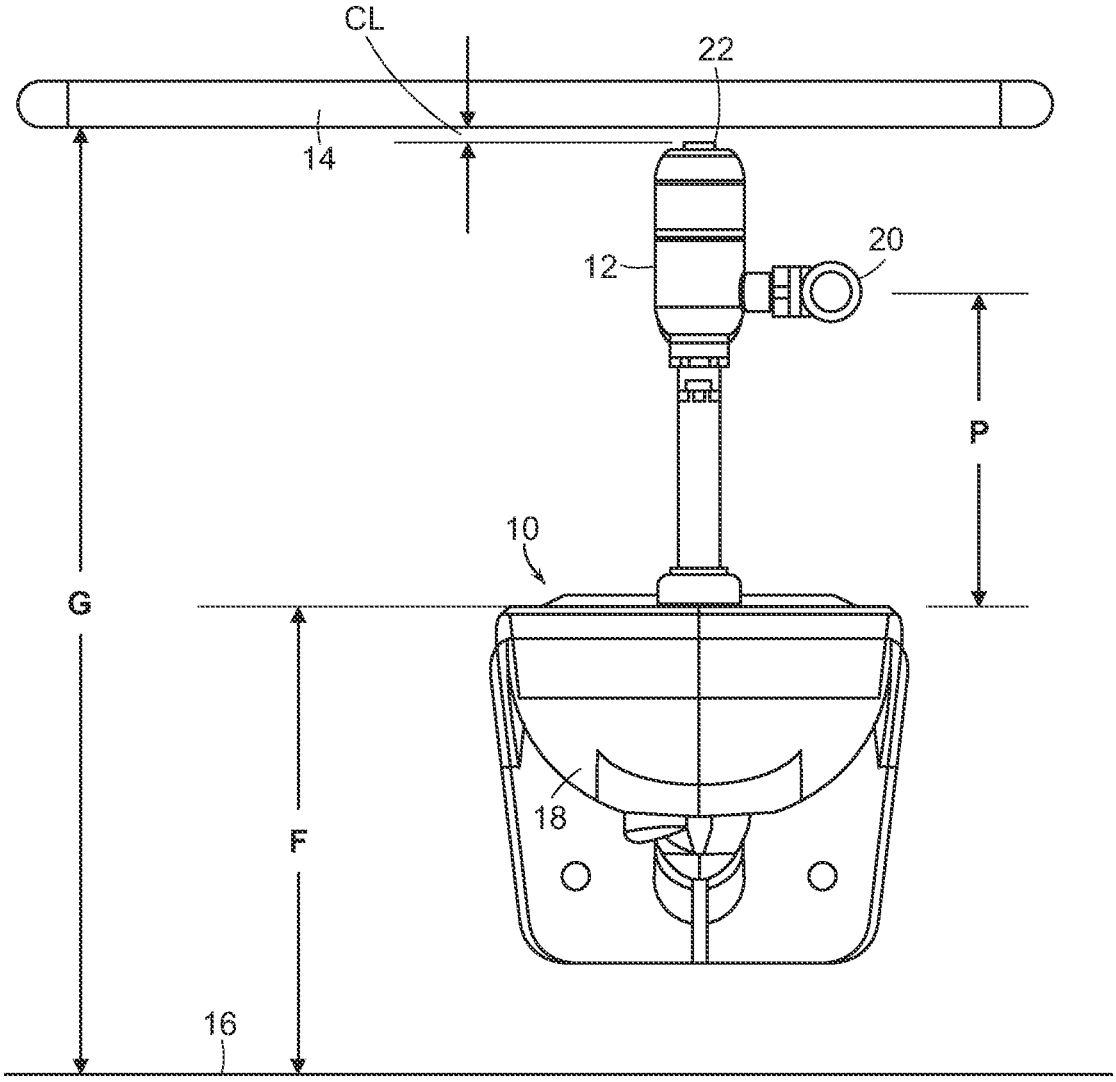
FIG. 1 (Prior Art)
FIG. 1 is an elevation view of a prior art water closet with a flushometer installed beneath a grab bar.
Figure 2:
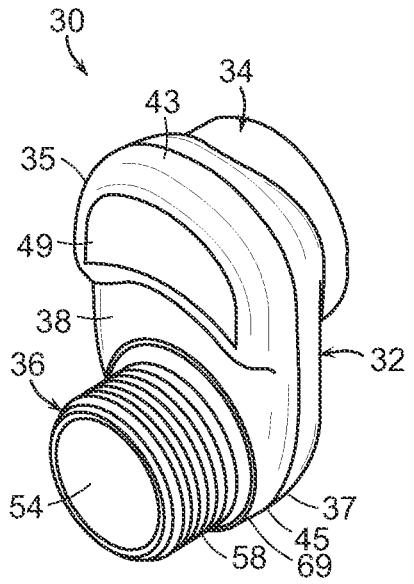
FIG. 2 is perspective view of an offset adapter for use with a flushometer.
Figure 3:
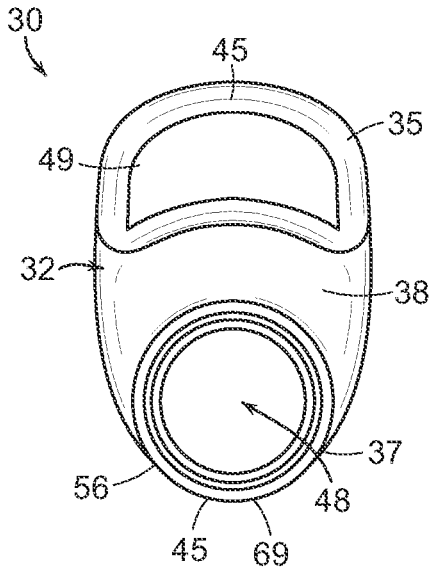
FIG. 3 is a front elevation view of the offset adapter of FIG. 1.
Figure 4:
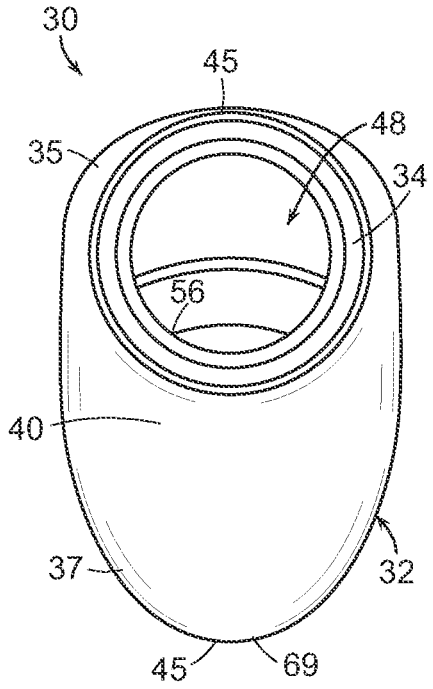
FIG. 4 is a rear elevation view of the offset adapter of FIG. 1.
Figure 5:
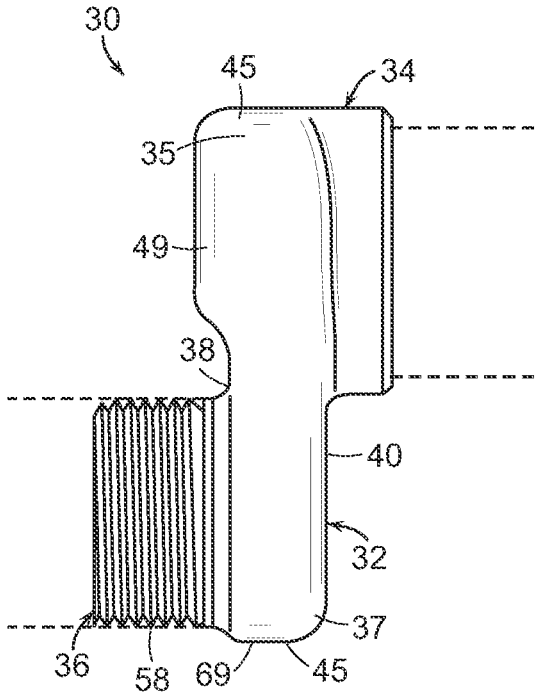
FIG. 5 is a side elevation view of the offset adapter of FIG. 1.

The same reference numbers are used in the drawings for similar or identical components and features shown in various alternative embodiments. Offset adapters as disclosed herein would have configurations and components determined, in part, by the intended application and environment in which they are used.

DETAILED DESCRIPTION OF EMBODIMENTS

Figure 8:
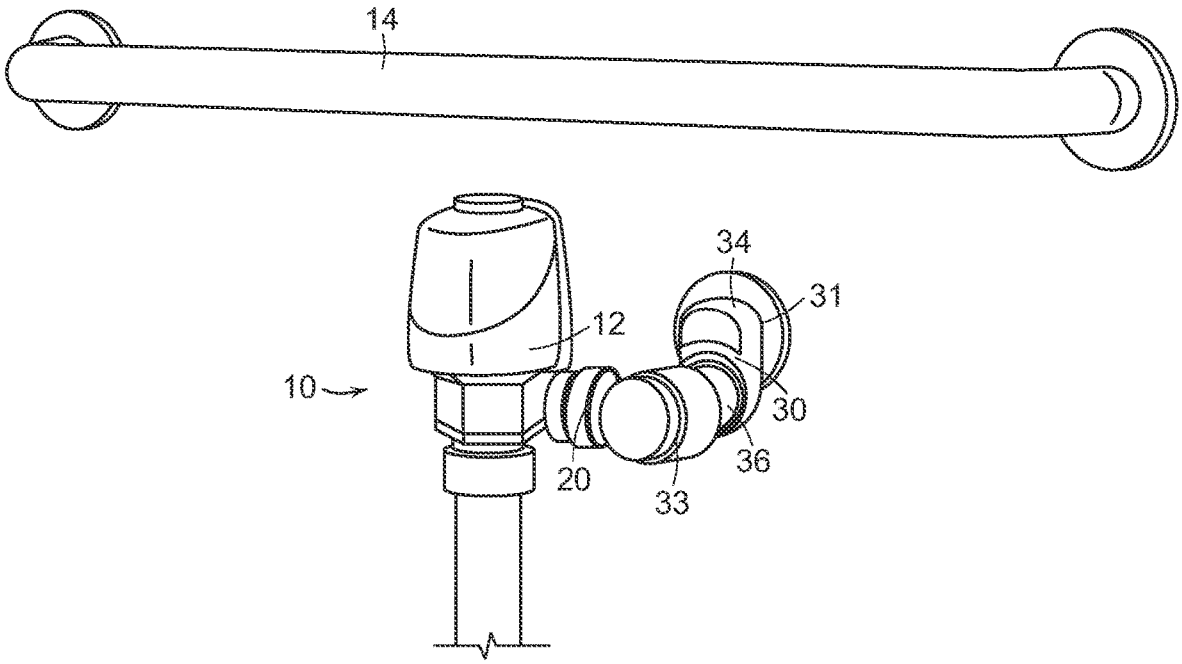
FIG. 8 is a perspective view of the offset adapter of FIGS. 2-7 installed with a water closet.

FIGS. 2-6 illustrate a representative offset adapter 30 for use with a flushometer 12 of a flush toilet or water closet 10 as illustrated in FIG. 1. Offset adapter 30 may have a body 32, an inlet portion 34 connected to an upper end 35 of body 32, and an outlet portion 36 connected to a lower end 37 of body 32. Inlet portion 34 may be connected to a water line of existing rough-in plumbing, and outlet portion 36 may be connected to inlet piping 20 of flushometer 12, i.e., a control stop and/or a tail of the flushometer 12. FIG. 8 illustrates the offset adapter 30 installed in a water closet 10, with the inlet portion 34 connected to a rough-in water line 31 and the outlet portion 36 connected to a control stop 33.

Offset adapter 30 advantageously allows a connection to existing rough-in plumbing, and a connection to inlet piping 20 of flushometer 12 at a lower point than the standard height P of 11.5 inches above the top of bowl 18, while still connecting to flushometer 12 at the same distance from the wall. This is achieved by the design of offset adapter 30, which has an offset height between the inlet portion 34 and the outlet portion 36 and has a length or depth that is significantly less than would be required by a standard offset adapter having a pair of 90 degree fittings, as described in greater detail below. Such a design will provide for the necessary clearance for flushometer 12 below a grab bar mounted 36 inches above the ground surface, e.g., for ADA-compliance.

Offset adapter 30 may be formed of various materials with various finishes including polished chrome, brushed nickel, polished brass, brushed stainless, and graphite, for example. In one embodiment, the offset adapter 30 is molded from a metal material (e.g., brass) and then machined to final shape.

In the embodiment of FIGS. 2-6, body 32 has a front wall 38 and a rear wall 40 spaced from front wall 38 and defining a body channel 42 therebetween, a top 43, and an opposed bottom 45. Body 32 also has side walls 47 extending between front and rear walls 38, 40 and further defining body channel 42 in combination with front and rear walls 38, 40. Body channel 42 may extend substantially vertically within body 32. Body channel 42 may have a depth CH between front wall 38 and rear wall 40. In certain embodiments, depth CH may be between approximately 0.245 inches and approximately 0.295 inches, and, in other embodiments, depth CH may be approximately 0.270 inches.

Additionally, in certain embodiments, the cross-sectional area of the body channel 42 at the narrowest portion of the body channel 42 (taken parallel to the axes J and K) is between approximately 0.39 $in^2$ and approximately 0.47 $in^2$, and, in other embodiments, this area may be approximately 0.430 $in^2$. This area is smaller than the cross-sectional area of the outlet channel 54 (measured perpendicular to the axis K) and the cross-sectional area of the inlet channel 48. In certain embodiments, the ratio of the cross-sectional area of the narrowest portion of the body channel 42 to the cross-sectional area of the outlet channel 54 is between approximately 0.487 and approximately 0.587 and, in other embodiments, this ratio may be approximately 0.537. In certain embodiments, the ratio of the cross-sectional area of the narrowest portion of the body channel 42 to the cross-sectional area of the inlet channel 48 is between approximately 0.492 and approximately 0.553 and, in other embodiments, this ratio may be approximately 0.522.

Figure 6:
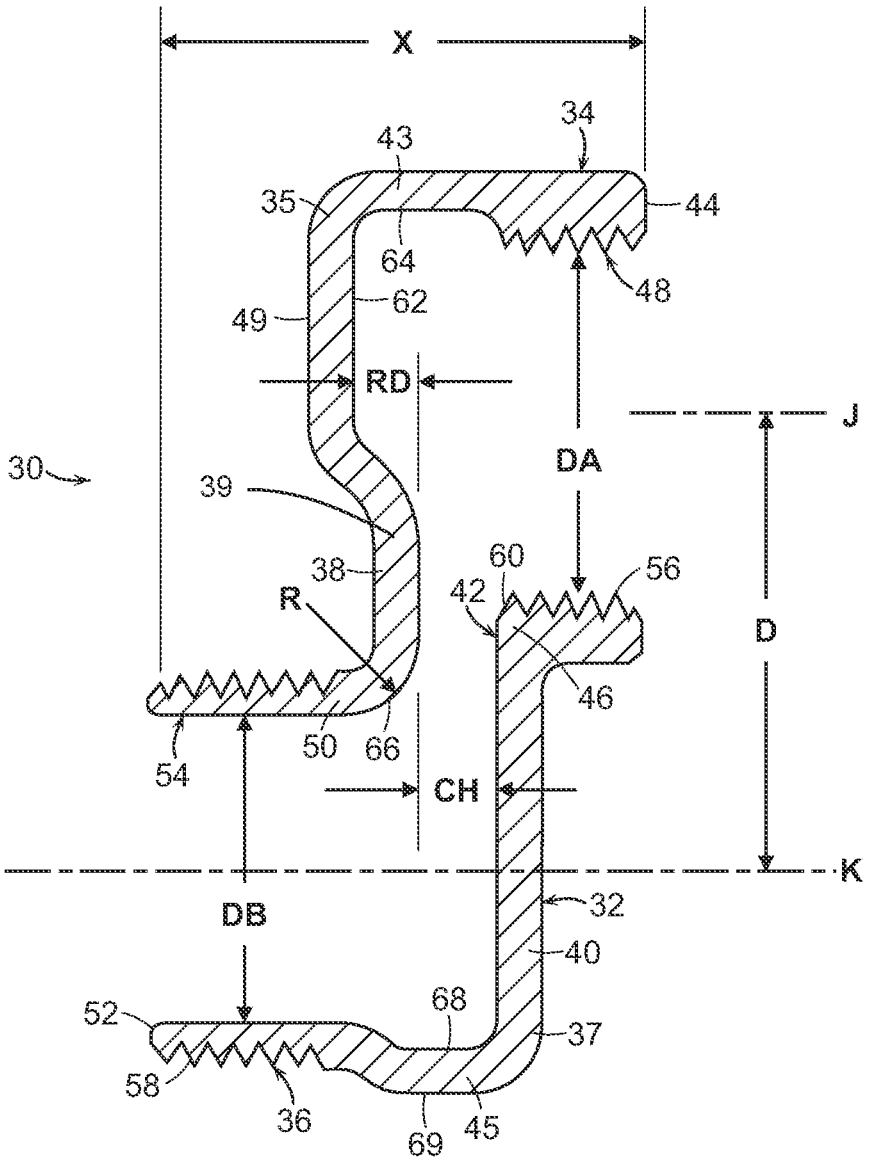
FIG. 6 is a section view, shown partially broken away, of the offset adapter of FIG. 1.
Figure 7:
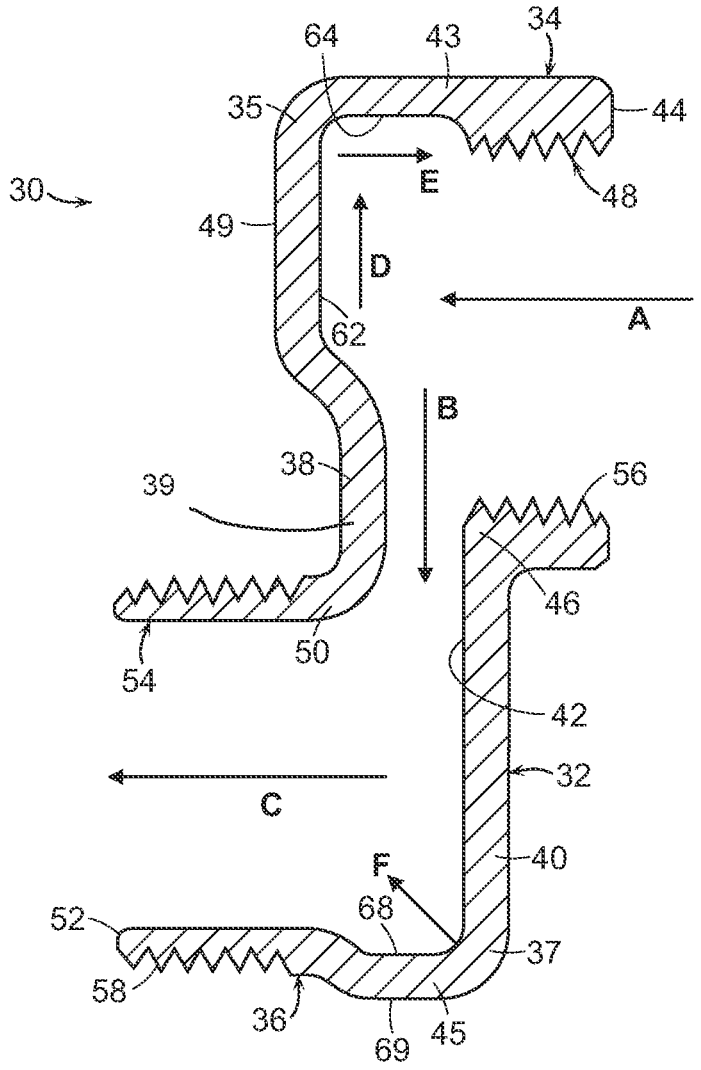
FIG. 7 is a section view, shown partially broken away, of the offset adapter of FIG. 1, showing water flow through the offset adapter.

Inlet portion 34 may have an open first end 44, and an opposed second end 46 connected to body 32, and an inlet channel 48 extending from first end 44 to second end 46 and in fluid communication with body channel 42. Inlet channel 48 may extend substantially horizontally within inlet portion 34. In certain embodiments, an inside corner 60 at an intersection of inlet channel 48 and body channel 42 may be beveled. In certain embodiments, inside corner 60 may be beveled at approximately 45°. In certain embodiments, as shown in FIGS. 6-7, a first recess 62 may be formed in the inner surface of front wall 38 of body 32 proximate top 43 of body 32 and opposite inlet channel 48, such that the surface of first recess 62 is positioned forwardly of body channel 42 a distance RD. In certain embodiments, distance RD may be between approximately 0.185 inches and approximately 0.235 inches, and, in other embodiments, distance RD may be approximately 0.210 inches. In one embodiment, as shown in FIGS. 2-7, first recess 62 is at least partially formed by a bulge 49 on the outer surface of front wall 38 of body 32, proximate top 43. Bulge 49 may extend forward/outward beyond the adjacent surfaces of front wall 38 by approximately the same distance as distance RD. A second recess 64 may be formed in the inner surface of top 43 of body 32 forwardly of second end 46 of inlet portion 34. First and second recesses 62, 64 are contiguous and continuous with each other in the embodiment of FIGS. 2-7. This configuration further creates an inward bulge 39 that narrows the body channel 42. In one embodiment, all inner surfaces of the inward bulge 39 have relatively large radii to ensure smooth flow and minimize turbulence. For example, none of the inner radii (including radius R) on the front wall 38 or the bottom 45 may be smaller than about 0.094 inch, in one embodiment. As another example, none of the internal (i.e., concave) radii may be smaller than about 0.094 inch, in one embodiment. The external radius at the juncture between the second end 46 of the inlet portion 34 and the rear wall 40 may have a smaller radius, e.g., about 0.031 inch.

Outlet portion 36 may have a first end 50 connected to body 32, an opposed open second end 52, and an outlet channel 54 extending from first end 50 to second end 52 and in fluid communication with body channel 42. Outlet channel 54 may extend substantially horizontally within outlet portion 36. In certain embodiments, an inside corner 66 at an intersection of outlet channel 54 and body channel 42 is radiused with a radius R. In certain embodiments, radius R may be approximately 0.10 inches. A third recess 68 may be formed in the inner surface of bottom 45 of body 32 rearwardly of first end 50 of outlet portion 36. Third recess 68 may also be formed in part by a bulge 69 extending downward/outward from bottom 45 of body 32, such as shown in FIGS. 6-7.

Offset adapter 30 is configured to create a vertical offset between inlet portion 34 and outlet portion 36. Inlet channel 48 has a central axis J, and outlet channel 54 has a central axis K, and the body channel 42 extends between the inlet and outlet channels 48, 54 transverse to both of the central axes J, K to create this offset. This vertical offset may be measured by a distance D between central axis J of inlet channel 48 and central axis K of outlet channel 54, as shown in FIG. 6. In one embodiment, distance D may be between approximately 1.25 inches and approximately 1.75 inches, and, in other embodiments, distance D may be approximately 1.5 inch.

Offset adapter 30 may have a length X between first end 44 of inlet portion 34 and second end 52 of outlet portion 36. In certain embodiments, length X may be between approximately 1.258 inches and approximately 2.258 inches (i.e., 1.758 inches+/−0.5 inch), or between approximately 1.535 inches and approximately 2.035 inches (i.e., 1.758 inches+/−0.25 inch), and, in other embodiments, length X may be approximately 1.758 inches.

In certain embodiments, a ratio of length X of offset adapter 30 to depth CH of body channel 42 may be between approximately 5.20 and approximately 8.31. In other embodiments, the ratio of length X of offset adapter 30 to depth CH of body channel 42 may be approximately 6.61.

Inlet portion 34 may have internal (i.e., female) threads 56 suitable for connection to a sweat solder adapter on the inlet water supply pipe of the rough-in plumbing (not shown), and outlet portion 36 may have external (i.e., male) threads 58 suitable for connection to an internally threaded fitting of flushometer 12.

In certain embodiments, offset adapter 30 may be a 1 inch female X 1 inch male 1.5 inch offset adapter. That is, inlet portion 34 may have an internal diameter DA of approximately 0.989 inches and 1 inch Female Pipe Thread ("FPT") internal threads 56, outlet portion 36 may have an internal diameter DA of approximately 0.956 inches and 1 inch Male Pipe thread ("MPT") external threads 58, and a distance D between central axis J of inlet portion 34 and central axis K of outlet portion 36 may be approximately 1.5 inch. This allows the inlet of flushometer 12 to be positioned 1.5 inch lower than the rough-in plumbing, while maintaining flushometer 12 at the same distance from the wall.

As illustrated in FIG. 7, the liquid flowing through offset adapter 30 initially passes through inlet channel 48 substantially horizontally and forwardly in the direction of arrow A, then through body channel 42 substantially vertically and downwardly in the direction of arrow B, and then exits offset adapter 30 by passing through outlet channel 54 substantially horizontally and forwardly in the direction of arrow C. The configuration of first recess 62 permits a recirculation current to form within first recess 62, such that a portion of the liquid flowing through offset adapter 30 may travel within first recess 62 substantially vertically upwardly in the direction of arrow D, opposite the direction of arrow B. A portion of the liquid flowing through offset adapter 30 may also travel within first recess 62 substantially horizontally rearwardly in the direction of arrow E, opposite the direction of arrow A. Some of the liquid passing through offset adapter 30 may swirl in multiple directions within first recess 62. Some of the liquid passing through offset adapter 30 may flow within third recess 68 substantially diagonally upwardly and forwardly in the direction of arrow F. The flow of liquid through first recess 62, second recess 64, and third recess 68 may help reduce the pressure drop of liquid flowing through offset adapter 30

The configuration of offset adapter 30 advantageously maintains adequate pressure and limits the pressure drop throughout inlet channel 48, body channel 42, and outlet channel 54. In certain embodiments, the pressure drop of liquid having a flow rate 15 GPM through inlet channel 48, body channel 42, and outlet channel 54 is no greater than 1 psi. Additionally, in certain embodiments, this pressure drop may be no greater than 0.7 psi at 10 GPM or 13.5 GPM flow rates, no greater than 1.8 psi or 2 psi at a flow rate of 20 GPM, no greater than 4.5 psi or 5 psi at a flow rate of 30 GPM, and no greater than 13 psi or 15 psi at a flow rate of 50 GPM. Additionally, the offset adapter 30 may experience a pressure drop across the offset adapter 30 of approximately 11.5% to approximately 13% of the inlet pressure, or about 12.25% of the inlet pressure, in various embodiments. It is understood that pressure drop may depend on various parameters, including flow rate.

Various embodiments of an offset adapter for a flushometer may include various components and features. In different embodiments, the offset adapter may be provided with any combination of such components and features. It is also understood that in other embodiments, the various devices, components, and features of the offset adapter described herein may be constructed with similar structural and functional elements having different configurations, including different ornamental appearances.

The terms "top," "bottom," "front," "side," "rear," and the like, as used herein, are intended for illustrative purposes only and do not limit the embodiments in any way. Nothing in this specification should be construed as requiring a specific three dimensional orientation of structures in order to fall within the scope of this invention, unless explicitly specified by the claims. The term "plurality," as used herein, indicates any number greater than one, either disjunctively or conjunctively, as necessary, up to an infinite number. The term "approximately" as used herein implies a variation of up to 5% of the nominal value modified by such term, or up to 5% of a midpoint value of a range modified by such term.

Those having skill in the art, with the knowledge gained from the present disclosure, will recognize that various changes can be made to the disclosed apparatuses and methods in attaining these and other advantages, without departing from the scope of the present disclosure. As such, it should be understood that the features described herein are susceptible to modification, alteration, changes, or substitution. For example, it is expressly intended that all combinations of those elements and/or steps which perform substantially the same function, in substantially the same way, to achieve the same results are within the scope of the embodiments described herein. Substitutions of elements from one described embodiment to another are also fully intended and contemplated. The specific embodiments illustrated and described herein are for illustrative purposes only, and not limiting of that which is set forth in the appended claims. Other embodiments will be evident to those of skill in the art. It should be understood that the foregoing description is provided for clarity only and is merely exemplary.

What is claimed is:

1. An offset adapter comprising:

a body having a front wall, a rear wall, and a body channel defined between the front wall and the rear wall and extending substantially vertically through the body;

an inlet portion having a first end, an opposed second end connected to the body, and an inlet channel extending from the first end to the second end and being in fluid communication with the body channel, the inlet channel having a first central axis extending in a horizontal direction;

an outlet portion having a first end connected to the body, an opposed second end, and an outlet channel extending from the first end to the second end and being in fluid communication with the body channel, the outlet channel having a second central axis extending in the horizontal direction, wherein the first central axis is offset with respect to the second central axis, and wherein the body channel extends transverse to the first central axis and the second central axis from the inlet channel to the outlet channel;

a first recess formed in an internal surface of the front wall of the body proximate a top of the body and opposite the inlet channel, wherein the first recess is formed by the front wall of the body extending further horizontally forward at the first recess relative to the body channel, such that a surface of the first recess is positioned forwardly of the body channel;

a second recess formed in an internal surface of a top of the body forward of the second end of the inlet portion; and a third recess formed in an internal surface of a bottom of the body rearward of the first end of the outlet portion.

2. The offset adapter of claim 1, wherein the offset adapter is configured such that liquid flows in a first direction into the inlet channel, in a second direction substantially perpendicular to the first direction through the body channel, and out of the outlet channel in the first direction, and is further configured such that a portion of the liquid flows within the first recess in a third direction extending opposite the second direction.

3. The offset adapter of claim 1, wherein an inside corner at an intersection of the inlet channel and the body channel is beveled.

4. The offset adapter of claim 1, wherein an inside corner at an intersection of the body channel and the outlet channel is radiused.

5. The offset adapter of claim 1, wherein an interior surface of the inlet portion has female pipe threading and is configured for connection to a rough-in water line, and an exterior surface of the outlet portion has male pipe threading and is configured for connection to inlet piping for a flushometer.

6. The offset adapter of claim 1, wherein an interior diameter of the inlet portion is approximately 0.989 inches.

7. The offset adapter of claim 1, wherein an interior diameter of the outlet portion is approximately 0.956 inches.

8. The offset adapter of claim 1, wherein a distance between the first central axis and the second central axis is approximately 1.5 inches.

9. An offset adapter comprising:

a body having a front wall, a rear wall, and a body channel defined between the front wall and the rear wall;

an inlet portion having a first end, an opposed second end connected to the body, and an inlet channel extending from the first end to the second end and being in fluid communication with the body channel, the inlet channel having a first central axis; and an outlet portion having a first end connected to the body, an opposed second end, and an outlet channel extending from the first end to the second end and being in fluid communication with the body channel, the outlet channel having a second central axis, wherein the first central axis is offset with respect to the second central axis, and wherein the body channel extends transverse to the first central axis and the second central axis from the inlet channel to the outlet channel, wherein a ratio of a length of the adapter extending between the first end of the inlet portion and the second end of the outlet portion to a depth of the body channel extending between the front wall of the body and the rear wall of the body is in a range of approximately 5.20 to approximately 8.31.

10. The offset adapter of claim 9, wherein an interior surface of the inlet portion is threaded.

11. The offset adapter of claim 9, wherein an exterior surface of the outlet portion is threaded.

12. The offset adapter of claim 9, wherein an interior diameter of the inlet portion is approximately 0.989 inches.

13. The offset adapter of claim 9, wherein an interior diameter of the outlet portion is approximately 0.956 inches.

14. The offset adapter of claim 9, wherein a distance between a centerline of the inlet portion and a centerline of the outlet portion is approximately 1.5 inches.

15. The offset adapter of claim 9, wherein an inside corner at an intersection of the inlet channel and the body channel is beveled.

16. The offset adapter of claim 9, wherein the first central axis and the second central axis each extend substantially horizontally, and the body channel extends substantially vertically.

17. The offset adapter of claim 16, further comprising a first recess formed in an interior surface of the front wall of the body proximate a top of the body and opposite the inlet channel, wherein the first recess is formed by the front wall of the body extending further horizontally forward at the first recess relative to the body channel, such that a surface of the first recess is positioned forwardly of the body channel.

18. The offset adapter of claim 17, further comprising a second recess formed in an interior surface of a top of the body forward of the second end of the inlet portion.

19. The offset adapter of claim 18, further comprising a third recess formed in an interior surface of a bottom of the body rearward of the first end of the outlet portion.

20. An offset adapter comprising:

a body having a front wall, a rear wall, and a body channel extending between the front wall and the rear wall;

an inlet portion having a first end, an opposed second end connected to the body, and an inlet channel extending from the first end to the second end and being in fluid communication with the body channel, the inlet channel having a first central axis; and an outlet portion having a first end connected to the body, an opposed second end, and an outlet channel extending from the first end to the second end and being in fluid communication with the body channel, the outlet channel having a second central axis, wherein the first central axis is offset with respect to the second central axis, and wherein the body channel extends transverse to the first central axis and the second central axis from the inlet channel to the outlet channel, wherein an interior surface of the inlet portion has female pipe threading and is configured for connection to a rough-in water line, wherein an exterior surface of the outlet portion has male pipe threading and is configured for connection to inlet piping for a flushometer, wherein a length of the adapter extending between the first end of the inlet portion and the second end of the outlet portion is 1.758 inches+/−0.5 inches, and wherein a distance between the first central axis and the second central axis is 1.5 inches+−0.25 inches.

21. The offset adapter of claim 20, further comprising a first recess formed in an interior surface of the front wall of the body proximate a top of the body and opposite the inlet channel, a surface of the first recess being positioned forwardly of the body channel.

22. The offset adapter of claim 21, further comprising a second recess formed in an interior surface of a top of the body forward of the second end of the inlet portion.

23. The offset adapter of claim 22, further comprising a third recess formed in an interior surface a bottom of the body rearward of the first end of the outlet portion.

24. The offset adapter of claim 23, wherein the offset adapter is configured such that liquid flows in a first direction into the inlet channel, in a second direction substantially perpendicular to the first direction through the body channel, and out of the outlet channel in the first direction, and is further configured such that a portion of the liquid flows within the first recess in a third direction extending opposite the second direction.

* * * * *